US009856713B2

(12) United States Patent
Tarique et al.

(10) Patent No.: US 9,856,713 B2
(45) Date of Patent: Jan. 2, 2018

(54) APPARATUS AND METHOD FOR CONTROLLED PRESSURE DRILLING

(75) Inventors: Zaurayze Tarique, Calgary (CA); George James Michaud, Calgary (CA)

(73) Assignee: SMITH INTERNATIONAL INC., Houston, TX (US)

( * ) Notice: Subject to any disclaimer, the term of this patent is extended or adjusted under 35 U.S.C. 154(b) by 0 days.

(21) Appl. No.: 13/252,853

(22) Filed: Oct. 4, 2011

(65) Prior Publication Data

US 2012/0085545 A1 Apr. 12, 2012

Related U.S. Application Data

(60) Provisional application No. 61/389,812, filed on Oct. 5, 2010.

(51) Int. Cl.

| | |
|---|---|
| ***E21B 33/076*** | (2006.01) |
| ***E21B 33/035*** | (2006.01) |
| ***E21B 23/00*** | (2006.01) |
| ***E21B 33/08*** | (2006.01) |

(52) U.S. Cl.

CPC ..... *E21B 33/085* (2013.01)

(58) Field of Classification Search

USPC ..... 166/338, 344, 345, 350–352, 360, 367, 166/378–380, 382, 75.14, 84.2, 84.3, 85.1

See application file for complete search history.

(56) References Cited

U.S. PATENT DOCUMENTS

| | | | | |
|---|---|---|---|---|
| 4,109,942 A * | 8/1978 | Morrill | 285/123.13 |
| 4,388,971 A * | 6/1983 | Peterson | 166/387 |
| 4,693,534 A * | 9/1987 | Clark | 439/276 |
| 4,712,614 A * | 12/1987 | Allwin et al. | 166/208 |
| 5,322,137 A * | 6/1994 | Gonzales | 175/195 |
| 5,647,444 A | 7/1997 | Williams | |

(Continued)

FOREIGN PATENT DOCUMENTS

WO 2010144989 A1 12/2010

OTHER PUBLICATIONS

International Search Report and Written Opinion of the ISA; PCT/US2011/054801; mailed Apr. 24, 2012.

(Continued)

*Primary Examiner* — Matthew R Buck
*Assistant Examiner* — Stacy Warren
(74) *Attorney, Agent, or Firm* — David J. Smith

(57) ABSTRACT

A rotating flow head (RFH) has a housing having an internal bore with diameter substantially equal to that of a riser and at least one flow port proximate one longitudinal end thereof. First and second arrays of radially extensible and retractable locking elements are disposed circumferentially around the RFH housing. The RFH has a bearing assembly (BA) housing having an exterior diameter selected to fit within the internal bore of the RFH housing so as to provide an annular space therein. The BA housing engages one of the arrays of locking elements when extended. A mandrel is rotatably, sealingly supported within the BA housing. Another end of the BA housing and the other array of locking elements provide longitudinal force on the BA housing when the other array is extended. A seal element disposed in the annular space is energized by the longitudinal force applied to the BA housing.

23 Claims, 12 Drawing Sheets

(56) References Cited

U.S. PATENT DOCUMENTS

| | | | | |
|---|---|---|---|---|
| 6,129,152 | A * | 10/2000 | Hosie | E21B 33/085 166/384 |
| 6,520,253 | B2 * | 2/2003 | Calder | E21B 33/085 166/84.2 |
| 7,258,171 | B2 * | 8/2007 | Bourgoyne et al. | 166/382 |
| 7,699,109 | B2 | 4/2010 | May | |
| 7,766,100 | B2 * | 8/2010 | Williams et al. | 175/195 |
| 2003/0136556 | A1 * | 7/2003 | Cornelssen et al. | 166/65.1 |
| 2004/0079532 | A1 * | 4/2004 | Allen et al. | 166/379 |
| 2009/0057025 | A1 * | 3/2009 | Williams | 175/195 |
| 2009/0139724 | A1 * | 6/2009 | Gray et al. | 166/345 |
| 2010/0175882 | A1 * | 7/2010 | Bailey et al. | 166/335 |
| 2010/0187015 | A1 | 7/2010 | Williams | |
| 2011/0174501 | A1 * | 7/2011 | Struthers | E21B 17/025 166/379 |
| 2012/0012335 | A1 * | 1/2012 | White et al. | 166/379 |

OTHER PUBLICATIONS

Mexican First Official Action for corresponding Mexican Appln. Ser. No. MX/a/2013/003864, dated Oct. 16, 2015, 11 pages.

* cited by examiner

APPARATUS AND METHOD FOR CONTROLLED PRESSURE DRILLING

CROSS-REFERENCE TO RELATED APPLICATIONS

Priority is claimed from U.S. Provisional Application No. 61/389,812 filed Oct. 5, 2010 and incorporated by reference as if fully set forth herein.

STATEMENT REGARDING FEDERALLY SPONSORED RESEARCH OR DEVELOPMENT

Not applicable.

BACKGROUND

In drilling wellbores through subsurface formations, e.g., for extraction of materials such as hydrocarbons, it is known in the art to directly or indirectly mount a rotating control device (RCD) on the top of a wellhead or a blowout preventer (BOP) stack. The BOP stack may include an annular sealing element (annular BOP), and one or more sets of "rams" which may be operated to sealingly engage a pipe "string" disposed in the wellbore through the BOP or to cut the pipe string and seal the wellbore in the event of an emergency.

The RCD is an apparatus used for well operations which diverts fluids such as drilling mud, surface injected air or gas and other produced wellbore fluids, including hydrocarbons, into a recirculating or pressure recovery "mud" (drilling fluid) system. The RCD serves multiple purposes, including sealing tubulars moving in and out of a wellbore under pressure and accommodating rotation and longitudinal motion of the same. Tubulars can include a kelly, pipe or other pipe string components, e.g., parts of a "drill pipe string" or "drill string."

Typically, a RCD incorporates three major components that work cooperatively with one another to hydraulically isolate the wellbore while diverting wellbore fluids and permitting a pipe string (e.g., a string) to rotate and move longitudinally while extending through the RCD. An outer stationary housing having an axial bore is hydraulically connected to the wellhead or BOP. The outer stationary housing can have one or more ports (typically on the side thereof) for hydraulically connecting the axial bore of the housing to return flow lines for accepting returning wellbore fluids. A bearing assembly is replaceably and sealingly fit within the axial bore of the outer housing for forming an annular space therebetween. Wellbore fluids can travel along the annular space and can be redirected out the side ports to the recirculating or pressure recovery mud system.

The bearing assembly comprises a rotating inner cylindrical mandrel replaceably and sealingly fit within a bearing assembly housing. An annular bearing space is formed between the rotating inner cylindrical mandrel and the bearing assembly housing for positioning bearings and sealing elements. The bearings permit the mandrel to rotate within the bearing assembly housing while the sealing elements isolate the bearings from wellbore fluids.

In deep water offshore applications, the RCD can be installed either below or above a marine riser tensioning ring. The marine riser tensioning ring is supported below an offshore drilling unit ("rig") platform by tension cables. Installation of the RCD below the tensioning ring requires the outer stationary housing of the RCD to be incorporated into and during the manufacture of the marine riser.

Installation of the RCD below the tensioning ring can be advantageous because the RCD is manufactured specifically for the particular riser being used and thus is secured and stationary. The RCD, as part of the marine riser, is typically submerged and thus is not subjected to types of movement experienced by the rig platform and associated equipment above the water surface. The submerged RCD is substantially immune from movement such as heave and rotational movements caused by the ocean tides and currents. Further, because the return flow lines from the RCD are located below the tensioning cables of the rig platform, there is only very limited risk of the tensioning cables becoming entangled with the return flow lines.

However, because the outer stationary housing of the submerged RCD is manufactured as part of the riser system, the RCD cannot be used for any other application other than for the particular riser for which it was manufactured. The RCD thus becomes a component of an individual marine riser system that cannot be used in any other marine riser system. This further requires the RCD manufacturer to produce the RCD with all possible flow lines that the RCD may need to incorporate during its operational life as part of the particular marine riser system.

It is important to note that a submerged marine RCD is also subject to conditions that are not typically associated with RCDs used on land or above the water surface in marine drilling. Exposure to hydrostatic pressure, for example, necessitates the use of RCD specific and typically non-API (American Petroleum Institute) standard couplings. Such requirements further increase manufacturing and operational costs associated with using a RCD installed below the riser tensioning ring.

Another disadvantage of a submerged RCD is the limited access to the RCD. One of the most common sources of premature failure of RCDs is a result of the failure of the bearings between the bearing assembly housing and the mandrel. Failure of the bearings in an RCD below the tensioning ring requires the complete shutting down of well operations, closing all the sealing elements of the BOP and withdrawal of the riser system from the water to gain access to the failed and submerged RCD, and the removal thereof from the riser system. Repairs to the submerged RCD can be substantially time-consuming and thus what is known as "non-productive time" (NPT) increases significantly, driving up operational cost of the particular well affected by the failed RCD.

Although RCDs installed above a marine riser tensioning ring minimize the disadvantages mentioned above, simply installing a conventional RCD above the tensioning ring will not significantly reduce the NPT when operational equipment requires maintenance. It is still necessary to remove at least part of the riser from the wellbore and remove the entire RCD from the riser system in order to repair the failed internal components.

Common to RCDs installed either above or below the tensioning ring, typical in-service time numbers in the tens to low hundreds of hours before some part of the operational equipment requires service or other attention including drill bit replacement or other downhole equipment such as motors, turbines and measurement while drilling systems. It is desirable that a RCD last as at least long as other drill string components and not be the reason drilling operations are interrupted so as to result in NPT. Further, existing retrieval techniques risk loss of conventional RCD components downhole. Such loss may require time consuming and expensive retrieval ("fishing") operations to remove the lost components before drilling operations can resume.

There is a need for a rotating control device or rotating flow head that is easily accessible for repair and permits easy access to downhole tools requiring repair. There is also a need for a rotating control device that can be easily maintained and repaired on a rig platform to minimize NPT and minimize operational risk.

SUMMARY

One aspect of the invention is a rotating flow head for coupling within a wellbore riser. A rotating flow head according to one aspect of the invention includes a rotating flow head (RFH) housing having an internal bore with diameter substantially equal to that of the riser and at least one flow port proximate one longitudinal end thereof. The RFH housing includes a first array and a second array of radially extensible and retractable locking elements, wherein each array is disposed circumferentially around the RFH housing. A bearing assembly (BA) housing having an exterior diameter selected to fit within the internal bore of the RFH housing (so as to provide an annular space therein) is retrievably disposed in the RFH housing. The BA housing has profiles at one end thereof for engaging and being supported by one of the arrays of locking elements when the locking elements are extended. A mandrel is rotatably, sealingly supported within an internal bore of the BA housing. Another end of the BA housing and the other array of locking elements each have features that cooperate to provide longitudinal force on the BA housing when the other array of locking elements is extended, and wherein a seal element disposed in the annular space is energized by the longitudinal force applied to the BA housing.

Other aspects and advantages of the invention will be apparent from the description and claims which follow.

DETAILED DESCRIPTION

A rotating flow head (RFH), also known as a rotating control device (RCD), generally comprises an outer stationary housing supported on a wellhead, and a rotating cylindrical mandrel, such as a quill, for establishing a seal to a movable tubular such as a tubing, drill pipe or kelly. The mandrel is rotatably and axially supported by a bearing assembly comprising bearings and seal assemblies for isolating the bearing assembly from pressurized wellbore fluids.

Figure 1:
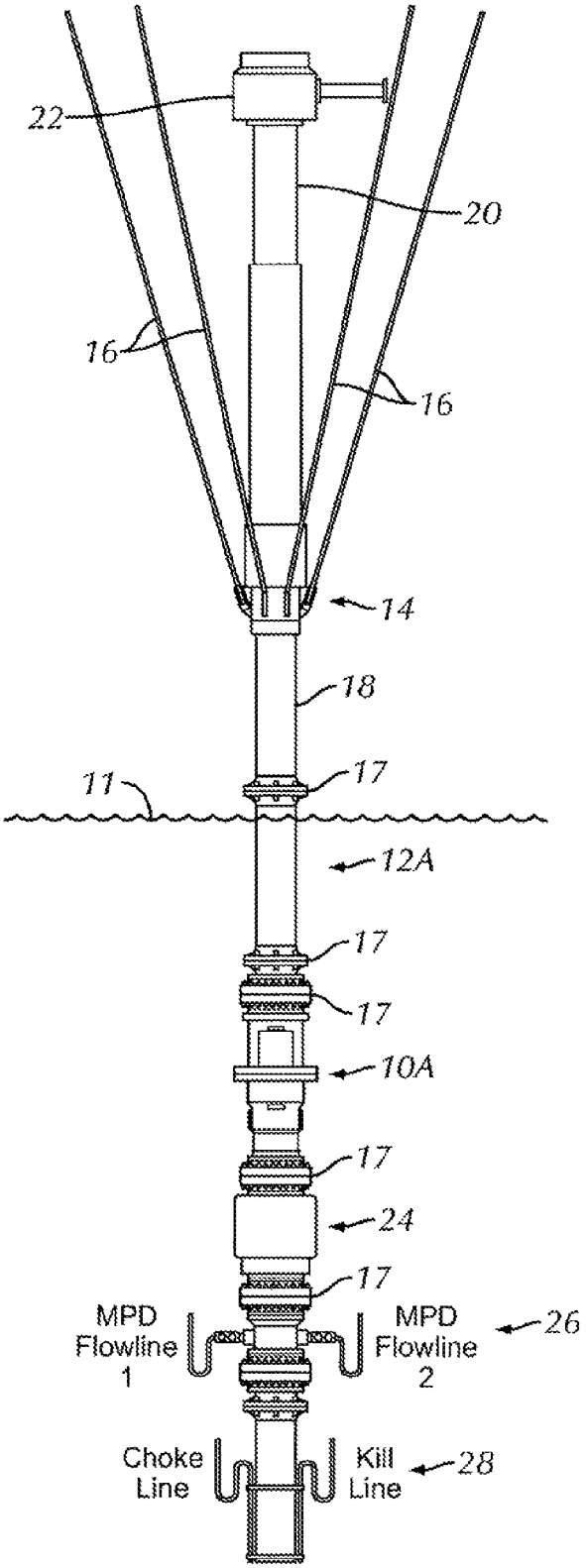
FIG. 1 (Prior Art)
FIG. 1 is a schematic representation of a conventional RCD installed below a marine riser tensioning ring known in the art.

FIG. 1 illustrates an RCD installation known in the art as used in connection with deep water drilling unit ("rig") platforms. The RCD 10A is supported on a submerged annular BOP 24, in a body of water 11 such as a lake or ocean, below a marine riser tensioning ring 14. Tension is applied to the riser tensioning ring 14 through tensioning lines 16 connected to the drilling rig or other buoyant devices. Returning flow lines (not shown) extend radially from the RCD 10A and are in fluid communication with a surface recirculating or pressure recovery mud system on a floor of the rig. Such system may include a slip joint 20 and return diverter 22. The slip joint 20 enables the marine riser 18 to change length in response to heave of the drilling rig (not shown). Flow spools 26, 28 may be disposed below the annular BOP 24 to provide hydraulic communication to the interior of the wellbore through, e.g., "choke" lines, "kill" lines and/or "booster" lines. The example shown in FIG. 1 has the various components of the riser system coupled to each other by bolted together flanges 17, although such couplings are not the only types which may be used in various examples of the invention. The riser may include a flex joint or pup joint 12A for spacing and lateral force accommodation.

Figure 2:
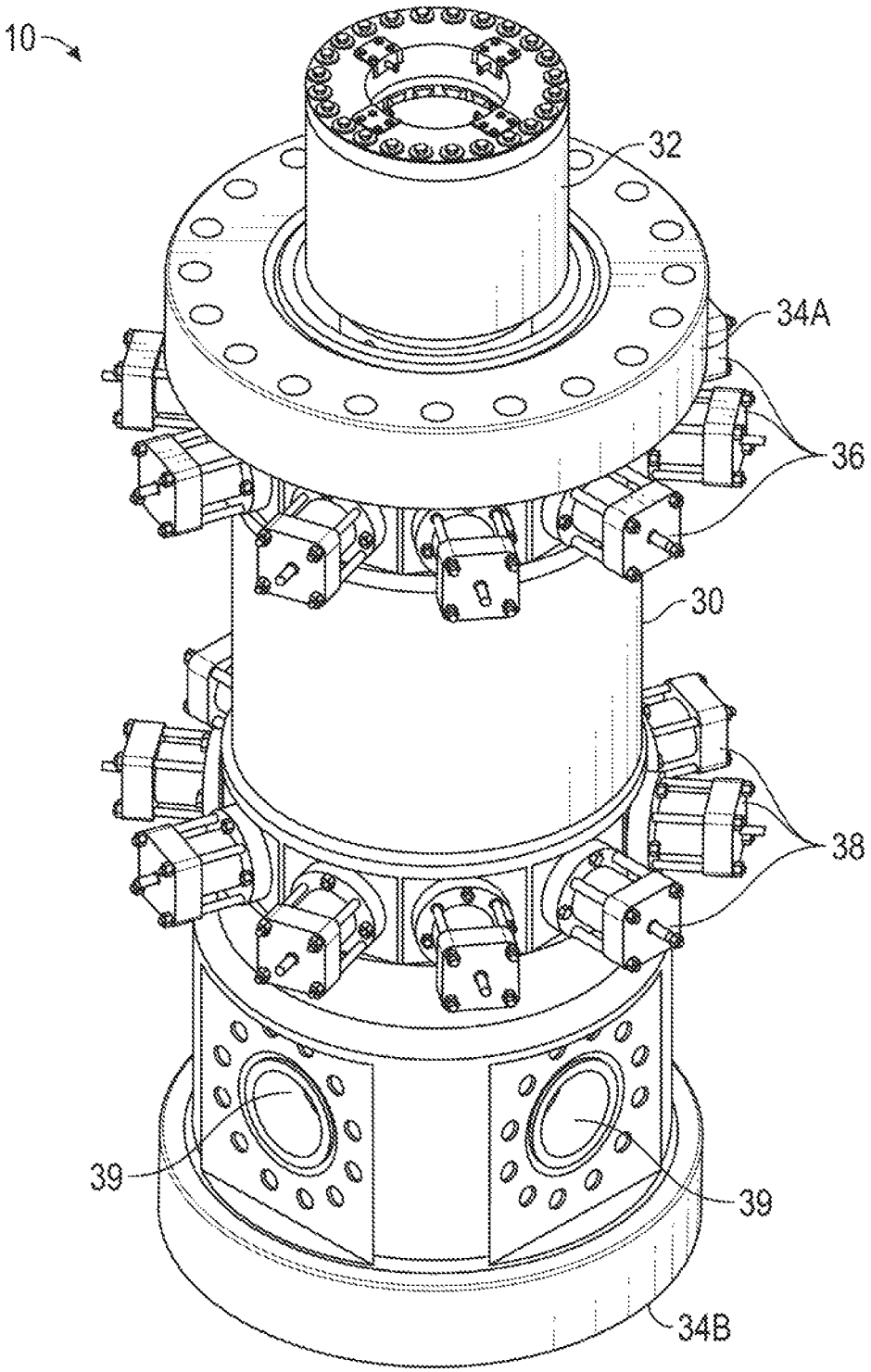
FIG. 2 is a perspective view of an example of the invention illustrating a RFH housing adapted to be supported above a marine riser tensioning ring, the housing having side ports for return fluid lines, an upper and a lower array of bearing housing retainers, and an inner cylindrical mandrel.

FIG. 2 illustrates an example rotating flow head (RFH) 10 according to the invention used in marine drilling comprising an outer, stationary housing ("RFH housing") 30 having a connector 34B (e.g., but not limited to a bolted flange) at a lower end to operatively connect the RFH housing 30 to a marine riser (e.g., as shown in FIG. 1) at a longitudinal position above the a riser tensioning ring (14 FIG. 1). The RFH housing 30 further comprises one or more side ports 39 for redirecting wellbore fluids entering the RFH housing 30 from below to fluid return flow lines (not shown) hydraulically connected to the pressure recovery mud system (not shown). Upper 36 and lower arrays 38 of locking fasteners that are radially extensible and retractable (in the present example, these may be lag bolts) may be circumferentially spaced around the RFH housing 30 for alternatively locking and unlocking functional components of the RFH 10 within the RFH housing bore (31 in FIG. 6). Such functional components may include a bearing assembly having an inner cylindrical mandrel 32, which will be explained in more detail below.

Figure 3:
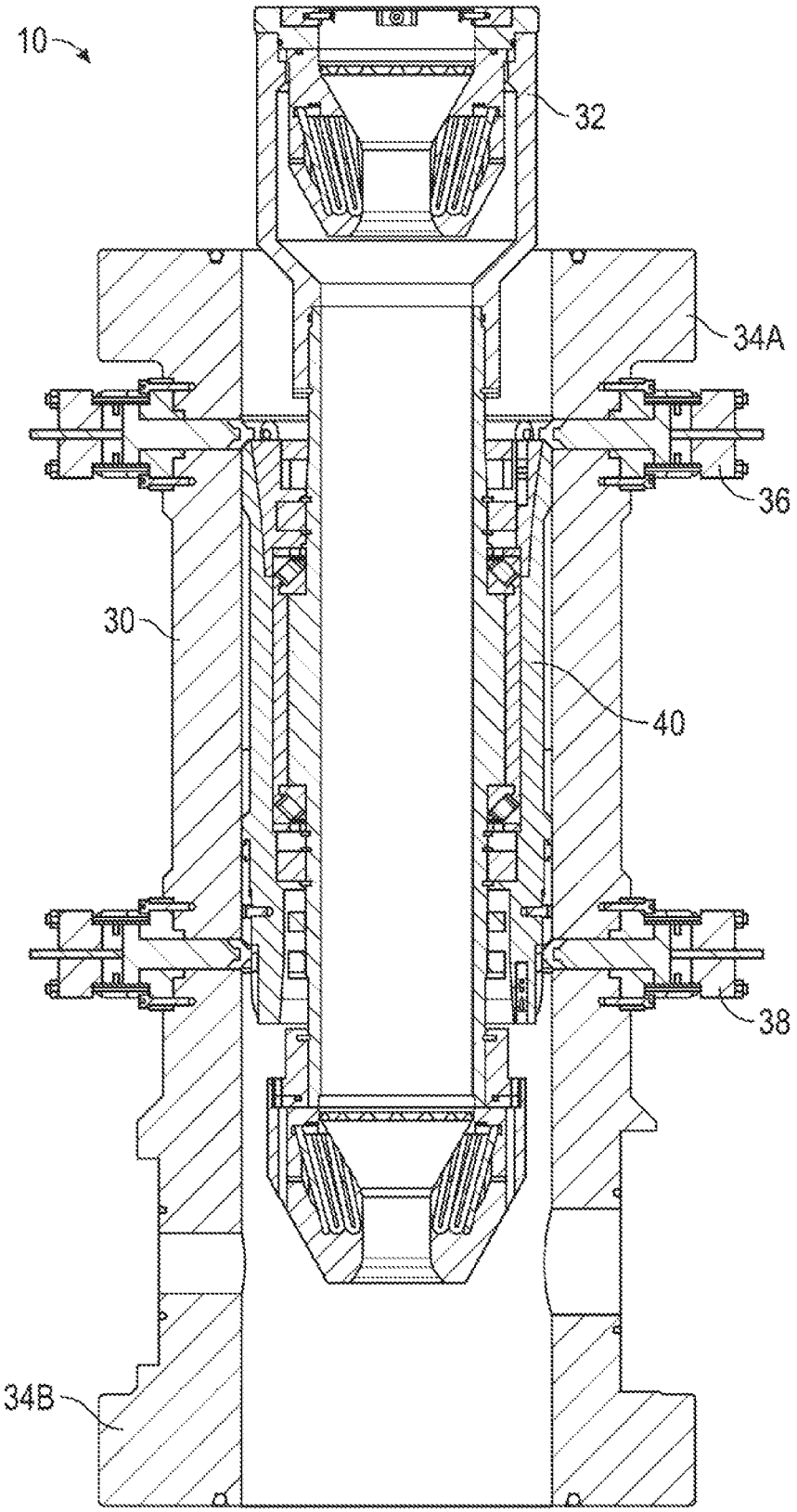
FIG. 3 is a side cross-sectional view of the RFH in FIG. 2, illustrating the RFH housing and bearing assembly comprising a bearing assembly housing, and the inner cylindrical mandrel.

As shown in FIG. 3, the RFH housing 30 may include therein a replaceable bearing assembly comprising a bearing assembly housing 40 having therein an inner cylindrical mandrel 32 permitting sealing passage therethrough of a tubular such as a drill string. The replaceable bearing assembly is supported and may be locked in place in the RFH housing 30 by the lower array 38 of lag bolts, while the upper array 36 of lag bolts also secures the bearing assembly within the RFH housing 30.

The inner cylindrical mandrel 32 comprises a lower sealing ("stripper") element, and can further comprise an upper sealing ("stripper") element for sealing around the tubular (e.g., a drill string) passing through the mandrel 32, as will be further explained below.

Figure 4:
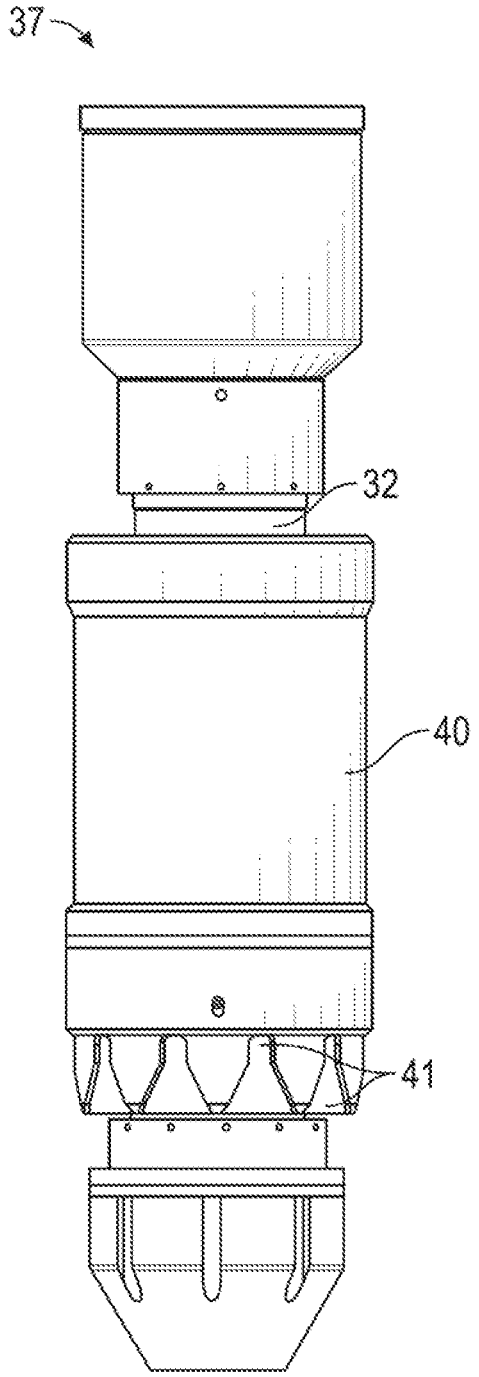
FIG. 4 is a side view of an example of the invention illustrating a bearing assembly having a bearing assembly housing and an inner cylindrical mandrel passing axially therethrough.
Figure 5:
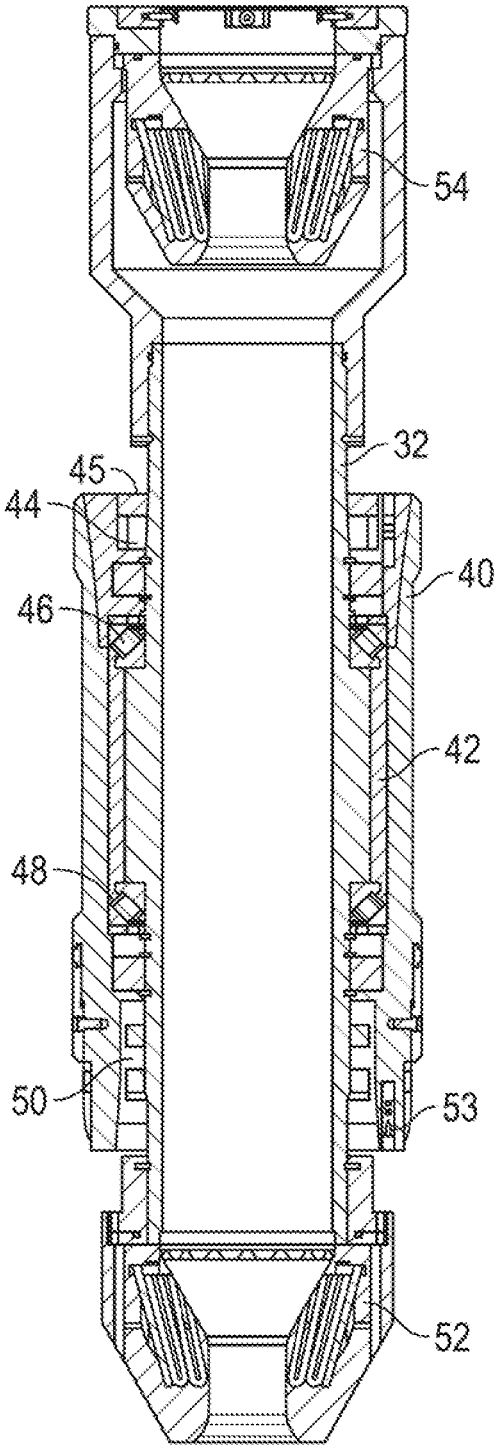
FIG. 5 is a side cross-sectional view of the bearing assembly of FIG. 4, illustrating the bearing assembly housing, inner cylindrical mandrel, and an annular bearing space therebetween for upper and lower sealing elements, upper and lower bearings, and replaceable upper and lower seal stacks.

An example of a replaceable bearing assembly is illustrated generally at 37 in FIGS. 4 and 5. The replaceable bearing assembly 37 may comprise the rotatable inner cylindrical mandrel 32, adapted for the sealing passage of a drill string or other tubular passing therethrough. The mandrel 32 passes through a bearing assembly housing 40. The bearing assembly housing 40 and the inner cylindrical mandrel 32 form an annular bearing space (42 in FIG. 5) therebetween for fitment of bearings (upper and lower respectively shown at 46 and 48 in FIG. 5) and sealing elements (upper and lower shown respectively at 44 and 50 in FIG. 5). The bearing assembly housing 40 and the inner cylindrical mandrel 32 may be secured to one another by way of a plurality of bolts 53 at a downhole end of the bearing assembly housing 40.

In FIG. 5, the upper 46 and lower 48 bearings, which may be tapered roller bearings, radially and axially support the inner cylindrical mandrel 32 within the bearing assembly housing 40. The upper 46 and lower 48 bearings may also be sufficiently axially spaced apart to compensate for any flexing or deflections experienced by the RFH (10 in FIG. 2) as a result of swaying of the drilling rig platform, and any flexing of a tubular (e.g., a drill string) passed through the inner cylindrical mandrel 32.

Between a top plate 45 in the bearing assembly housing 40 and the upper bearings 46 may be an upper sealing element or a stack of such elements, shown generally at 44. A lower sealing element 50 or stack thereof may be disposed below the lower bearings 48. The upper 44 and lower 50 sealing elements isolate the upper 46 and lower 48 bearings from wellbore fluids. Both the upper 44 and lower 50 sealing elements can be replaceable seal stacks comprising individual seals. The cylindrical mandrel 32 may include an upper sealing ("stripper") element 54 and a lower sealing ("stripper") element 52 which will be further explained below.

Figure 6:
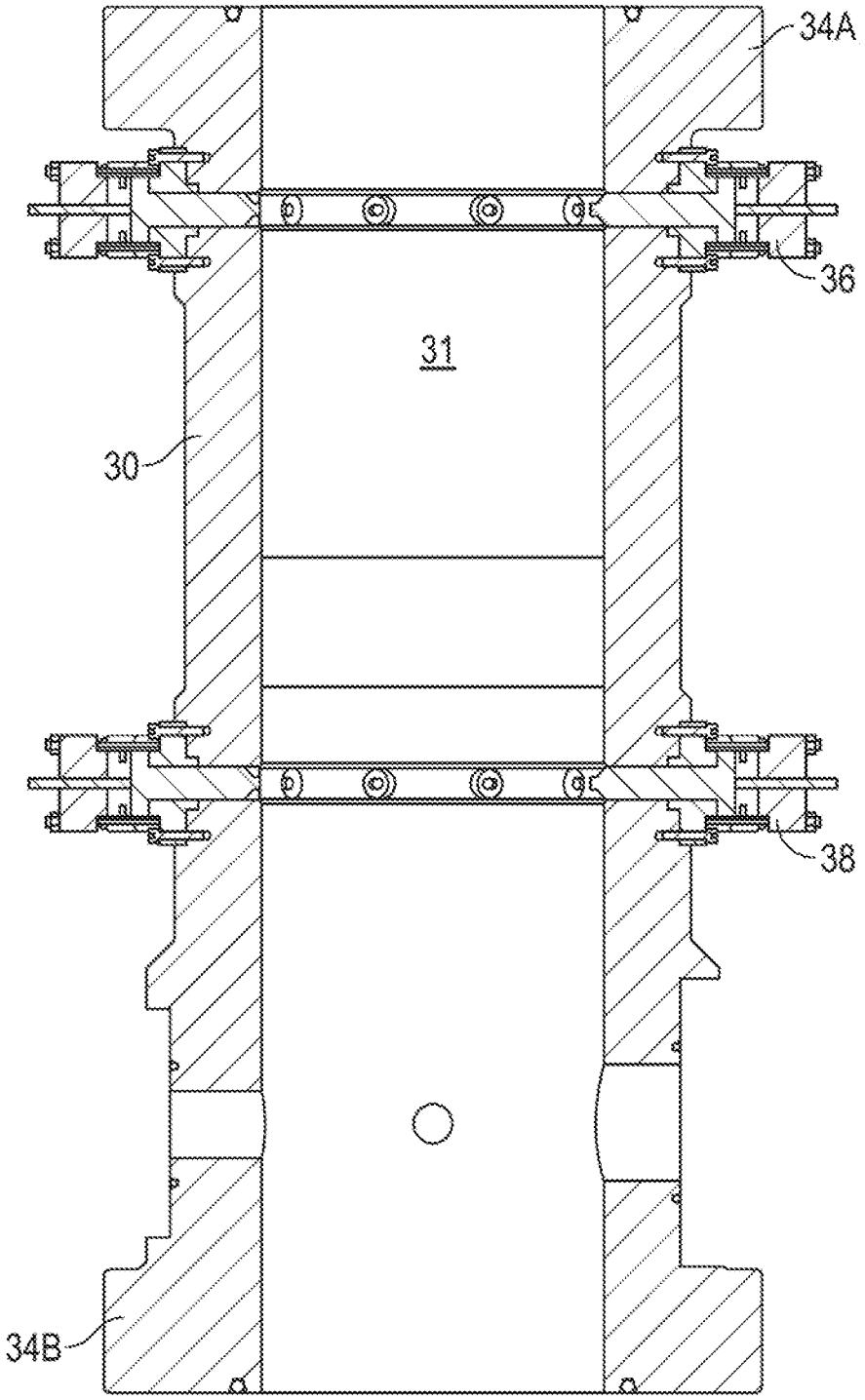
FIG. 6 is a side cross-sectional view of the RFH housing of FIG. 2, illustrating the upper and lower array of retainers (e.g., lag bolts).

FIG. 6 illustrates a cross-section of the example RFH housing 30 shown in oblique view in FIG. 2. The RFH housing 30 comprises a housing bore 31 extending axially therethrough and is adapted at a top portion, for example by an upper connector 34A (which, as a non-limiting example, may be a bolted flange) for hydraulically and mechanically connecting within a marine riser (e.g., as shown in FIG. 1, but as explained with reference to FIG. 2, preferably above the tensioner ring 14 shown in FIG. 1). A bottom end of the RFH housing 30 may further comprise a lower connector 34B (as a non-limiting example, a bolted flange similar to the upper connector 34A) for connecting the RFH housing 30 to a riser above the riser tensioning ring (e.g., 14 in FIG. 1).

The top portion of the RFH housing 30 further comprises an upper array 36 radially extensible and retractable locking fasteners, which may be a plurality of lag bolts circumferentially spaced about an outer surface of the RFH housing 30. In one example, at about the longitudinal center of the RFH housing 30, the RFH housing 30 may further comprise a lower array 38 of such radially extensible and retractable fasteners which may also be a plurality of lag bolts circumferentially spaced along the outer surface of the RFH housing 30. Each of the fasteners in upper 36 and lower 38 arrays of fasteners are operable between a closed position (extended into the interior of the RFH housing 30) and an opened (fully retracted from the interior of the RFH housing 30) position and can be actuated manually (e.g., using a remotely operated vehicle "ROV") or hydraulically (e.g., using an individual hydraulic motor coupled to each lag bolt, which is not shown in the figures) to radially extend or retract the fasteners towards or away from the housing bore 31 respectively. Lag bolts may be used advantageously in some examples because little force is required to maintain threaded devices such as bolts in a particular longitudinal position once the position is reached. Thus, when lag bolts or similar threaded devices are used for the fasteners (in upper 36 and lower 38 arrays), the extended, locking position thereof may be maintained with only slight frictional or other locking force to the bolts.

The upper 36 and lower 38 arrays of locking fasteners extend radially inward toward the housing bore 31 when being actuated from their opened position to their closed position. Conversely, the locking fasteners in each of the arrays, 36, 38 retract to clear the housing bore 31 when being actuated from its closed position to its opened position.

When in their opened positions, the locking fasteners are retracted away from the housing bore 31 for clearing the housing bore. A clear housing bore 31, in conjunction with a clear riser bore, provides a through-bore that may have a maximized and consistent internal diameter that is sufficient to permit passage of certain wellbore operating and/or intervention tools therethrough. This is substantially different than RCDs used, for example, in land-based drilling operations. The housing bores of such land-based RCDs, as disclosed, for example, in International Patent Application Publication No. WO 2010/144989, typically have a permanent supporting shoulder that extends radially inwards for supporting the bearing assembly thereon. The fixed or permanent supporting shoulder lessens the available maximum internal bore diameter, which may interfere with the passage of certain wellbore tools therethough.

Figure 7:
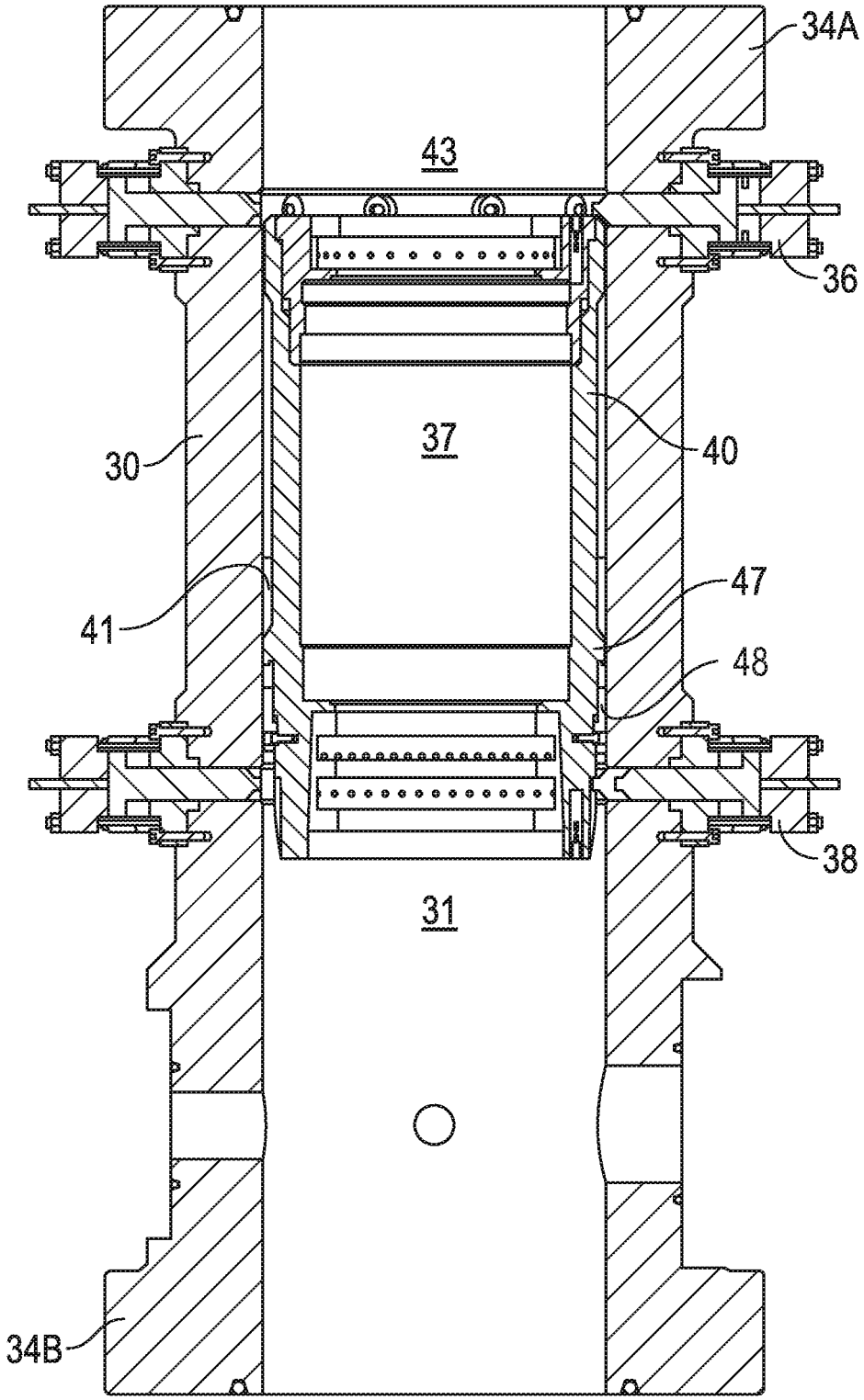
FIG. 7 is a side cross-sectional view of the RFH housing of FIG. 6 supporting the bearing assembly housing of FIG. 2, illustrating the lower array of retainers (lag bolts) supporting the bearing assembly housing within a RFH housing bore, the upper array of retainers (lag bolts) securing the bearing assembly housing within the RFH housing bore, and a compression packing to seal the annular space between the bearing assembly housing and the RFH housing.

FIG. 7 better illustrates the bearing assembly 37 with the bearing assembly housing 40 thereof replaceably disposed within the RFH housing bore 31. As shown in FIG. 7, the lower array 38 of locking fasteners (e.g., lag bolts), in their extended (closed) position, engage the bearing assembly housing 40 to support the bearing assembly 37 within the RFH housing bore 31. The upper array 36 of locking fasteners can be actuated into their extended (closed) position to secure the bearing assembly 37 within the RFH housing 30. The upper locking fasteners 36 may engage a top end 43 of the bearing assembly housing 40. Either or both the upper locking fasteners (e.g., lag bolts) and the top end 43 may be shaped, e.g., tapered so the locking fasteners in the upper array 36 may, when extended to their closed position, apply a downward longitudinal force on the bearing assembly housing 40 for securing the bearing assembly 37 in the RFH housing 30.

The bearing assembly housing 40 may further comprise an annular offset 42 above the lower array 38 of locking fasteners. A compression packing 48, e.g., a T seal, may be fit below and adjacent the annular offset 42 to isolate wellbore fluids from entering an annular space between the exterior of the bearing assembly housing 40 and the interior of the RFH housing 30. The compression packing 48 is energized to seal the annular bearing space 42 between the bearing assembly housing 40 and the RFH housing 30 by expanding radially inwardly and outwardly. The radial inward and outward expansion of the compression packing 44 may actuated by the downward axial movement of the bearing assembly housing 40 when secured within the RFH housing 30 by the foregoing action on the top 43 of the bearing assembly housing 40 by the upper array 36 of locking fasteners when extended. The engagement of the upper array 36 of fasteners with the top 43 of the bearing housing 40 may thus fully activate the compression packing 48.

Those skilled in the art will appreciate that a compression packing may have advantages over a conventional O-ring sealing element in such configuration, because a compression packing is not as susceptible to damage when the bearing assembly 37 is inserted and retrieved from the RFH housing 30.

The annular offset 47 further functions to centralize the bearing assembly housing 40 within the RFH housing bore 31.

Figure 8:
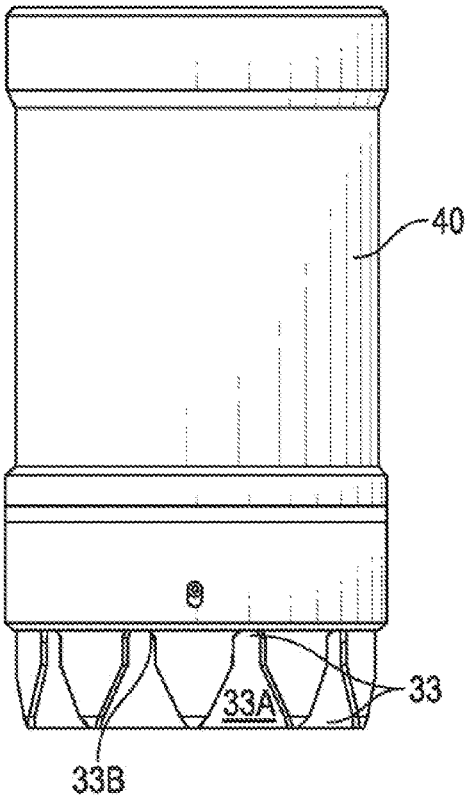
FIG. 8 is a side view of the bearing assembly housing of FIG. 7, illustrating a plurality of profiles at a downhole end of the bearing assembly housing, each profile defining a supporting shoulder.

With reference to FIG. 8, a downhole end of the bearing assembly housing 40 may further comprise a plurality of profiles 33 spaced circumferentially therearound. Each profile 33 has a cavity 33A defining a guide track extending longitudinally upward from the lower end of the bearing assembly housing 40 and terminating at a stop shoulder 33B. Each stop shoulder 33B may correspond with the circumferential position of each locking fastener of the lower array (38 in FIG. 7). Each lower locking fastener (FIG. 7) may engage a corresponding cavity 33A and individually or collectively cause the bearing assembly housing 40 to rotate for aligning the stop shoulders 33B with each lower lag bolt. The lower locking fasteners thus engage and longitudinally support the bearing assembly housing 40, and thus the bearing assembly (37 in FIG. 7), by engaging each corresponding stop shoulder 33B. The cooperation between each of the lower array (38 in FIG. 7) of locking fasteners with each corresponding stop shoulder 33B also may prevent rotation of the bearing assembly housing 40. In one example, the ends of the locking fasteners which engage the cavities 33A can be tapered to aid in engagement with the profiles 33 and stop shoulders 33B.

Figure 9:
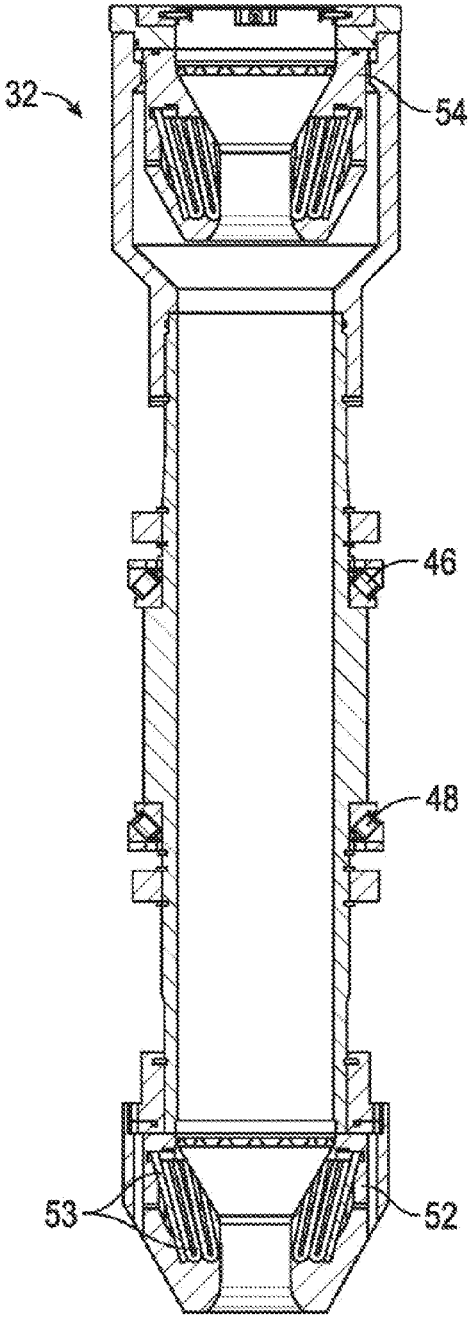
FIG. 9 is a side cross-sectional view of the inner cylindrical mandrel of FIG. 8, illustrating the upper and lower bearings and the upper and lower tubular sealing ("stripper") elements.

Referring now to FIG. 9, the inner cylindrical mandrel 32 may, as previously explained, include further an upper 54 and a lower 52 sealing ("stripper") element for sealingly engaging a tubular (e.g., a drill string) passed therethrough, while enabling longitudinal movement of the tubular through the mandrel 32. To increase the rigidity of the sealing elements 52, 54, and thus increase the frictional engagement of the sealing elements 52, 54 against the tubular (not shown), the sealing elements 52, 54 can comprise an elastomeric material reinforced with reinforcing strips, e.g., as shown at 53 in FIG. 9.

In preparation for drilling operations, the RFH housing (e.g., as shown at 30 in FIG. 6) is supported and connected to a riser string above a marine riser tensioning ring (e.g., as shown at 14 in FIG. 1). The RFH housing bore (31 in FIG. 6) cooperates with the riser bore (e.g., as shown in FIG. 1) to form a contiguous through-bore having a maximized and preferably a consistent internal diameter that is sufficient to permit passage of certain wellbore tools.

Figure 10:
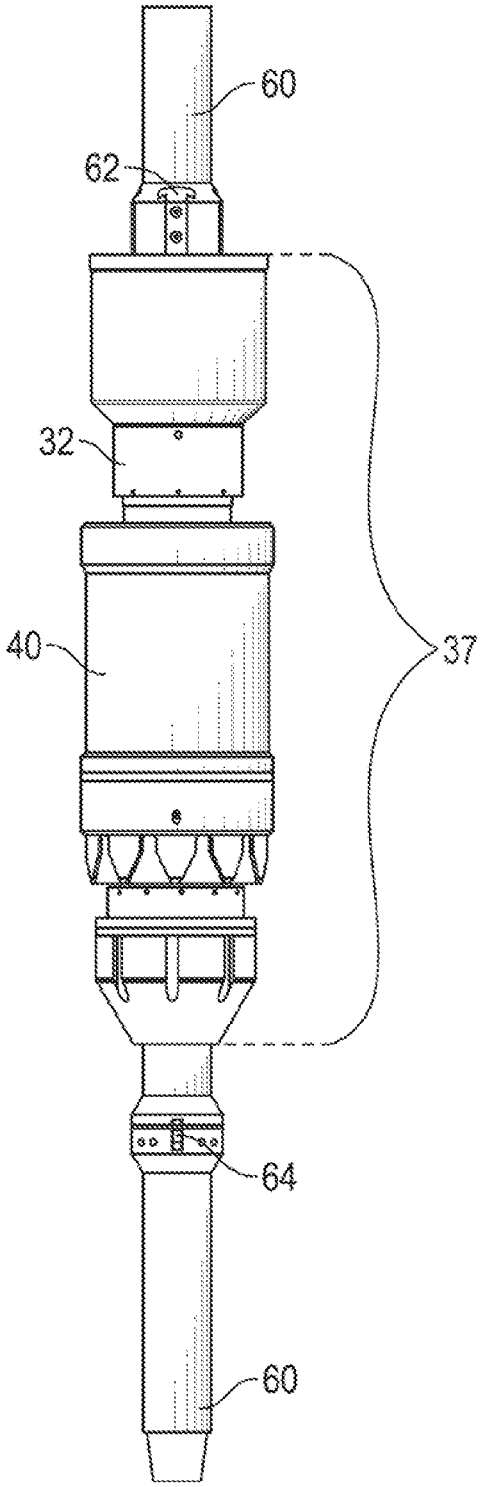
FIG. 10 is a side view of an example of the invention illustrating a running tool inserted through the bearing assembly for installing and removing the bearing assembly from the RFH housing.
Figure 11:
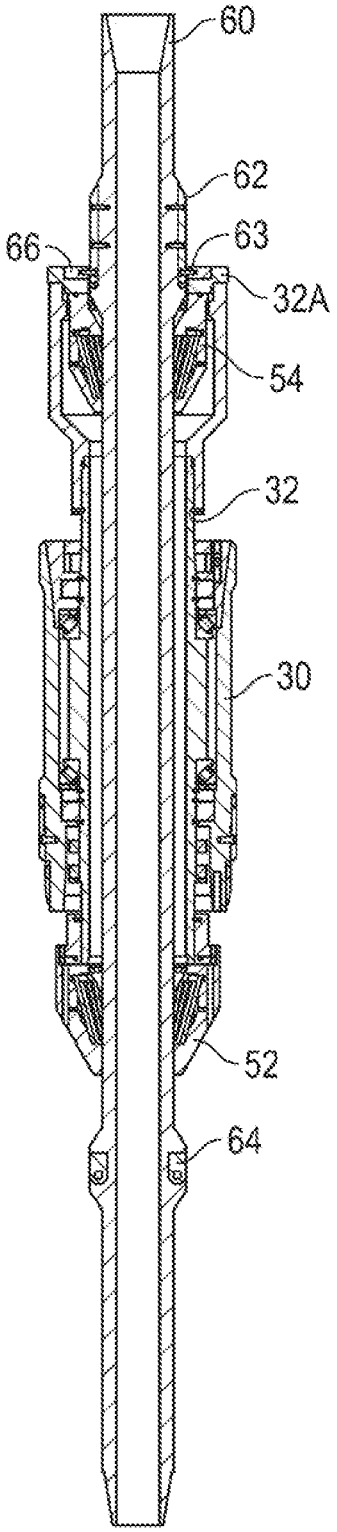
FIG. 11 is a side cross-sectional view of the running tool of FIG. 10.

With reference to FIGS. 10 and 11, a running tool 60 may then be operatively inserted longitudinally into the interior of the bearing assembly 37, generally through the interior bore of the mandrel 32. The running tool 60 can comprise a single tool having dual functions (for both running in and retrieving the bearing assembly 37), or the running tool 60 can be two separate tools, each such tool having a single function (i.e., running in or retrieving the bearing assembly 37). In one example, the running tool 60 can be used to install or fit the bearing assembly 37 within the RFH housing (30 in FIG. 11). In an alternative example, the running tool 60 can be used to remove or retrieve the bearing assembly 37 from the RFH housing (30 in FIG. 11). Additional elements related to the running tool 60, including a shear pin assembly 62, shear pins 63, shear pin blocks 66 and a top plate 32A on the cylindrical mandrel 32 will be further explained below.

Figure 12:
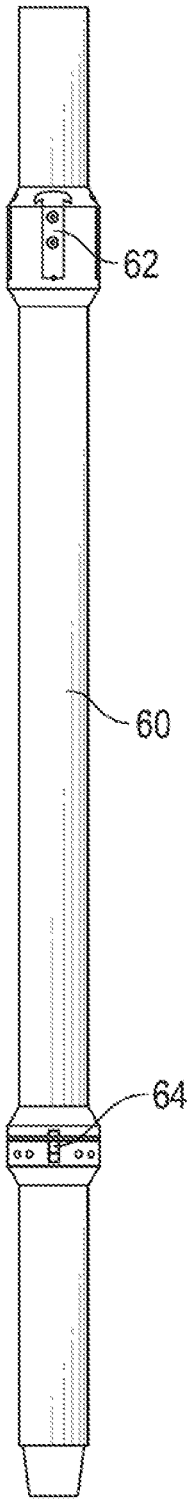
FIG. 12 is a side view of the running tool of FIGS. 10 and 11, illustrating an upper portion having shear pin assemblies and a lower portion having outwardly biased dogs.
Figure 13:
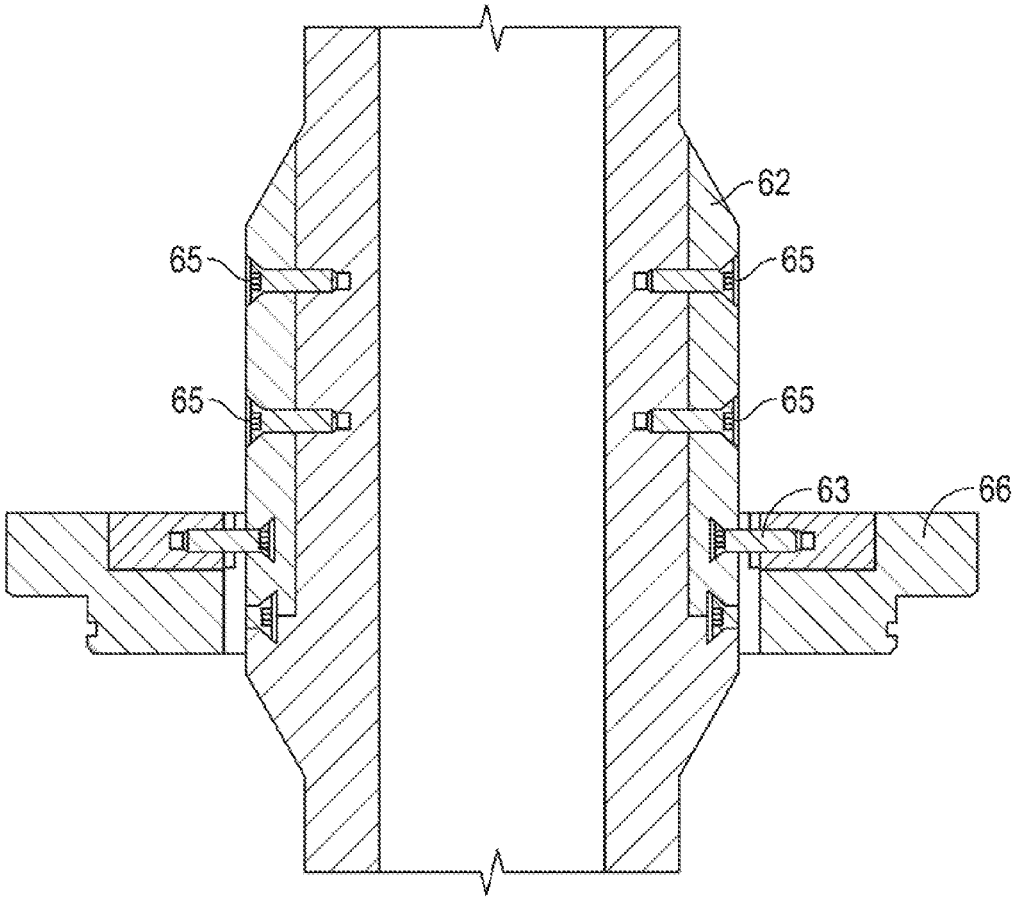
FIG. 13 is a side view of the upper portion of FIG. 12, illustrating a radially extending shear pin and its corresponding shear pin block.
Figure 14:
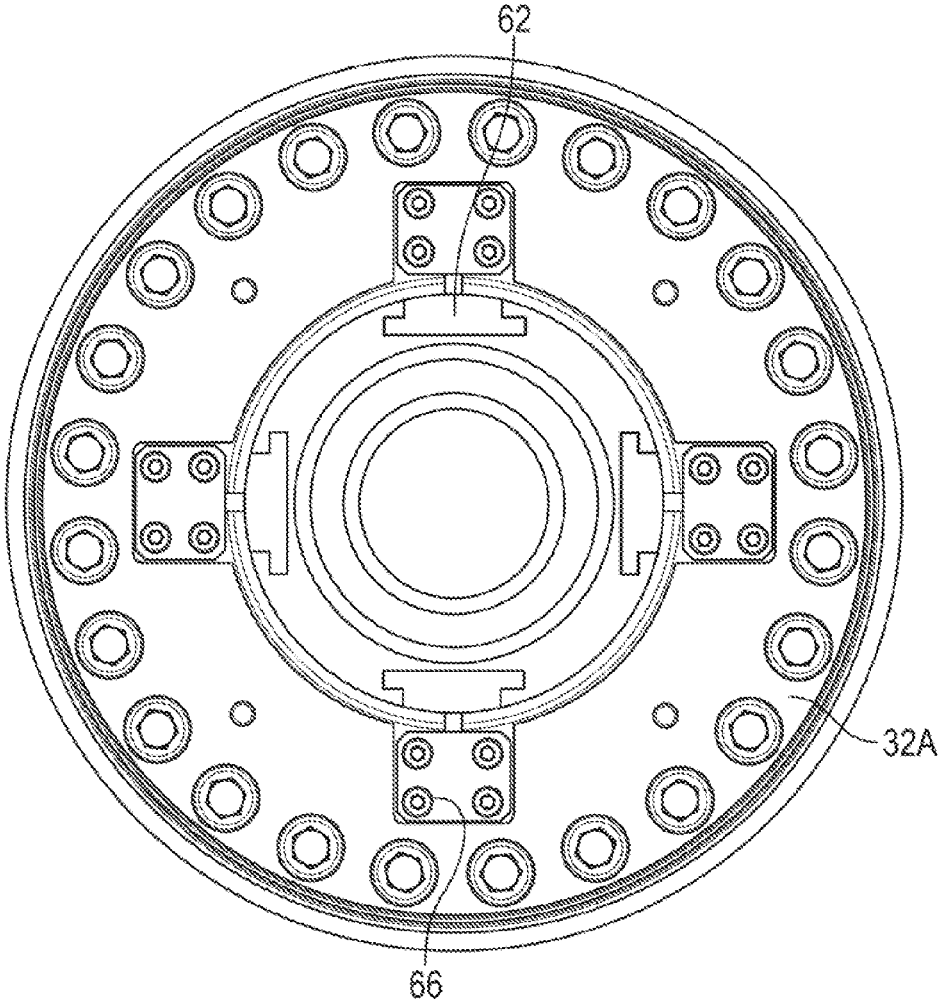
FIG. 14 is a top view of the inner mandrel secured to the bearing assembly by four shear pin assemblies secured to a top plate by four shear pin blocks.

As shown in FIGS. 12 to 14, the running tool 60 can comprise an uphole portion having two or more shear pin assemblies 62 circumferentially spaced thereabout for inserting or positioning the bearing assembly (37 in FIG. 10) within the RFH housing (30 in FIG. 11). A shear pin 63, secured within the shear pin assembly 62 extends radially outwardly from the shear pin assembly 62.

Each shear pin assembly 62 can be secured to the running tool 60 by way of one or more bolts as shown at 65 in FIG. 13. The running tool 60 is then longitudinally inserted into the bearing assembly (37 in FIG. 10) and then secured to the bearing assembly (37 in FIG. 10) by way of two or more shear pin blocks 66, there being one shear pin block 66 for each shear pin 63, as shown in FIG. 13. Each shear pin block 66 holds down its corresponding shear pin 63, and acts to secure the running tool 60 to the bearing assembly (as shown at 37 and 60 in FIG. 10).

Once the bearing assembly (37 in FIG. 10) has been secured to the running tool 60, the lower array (see 38 in FIG. 7) of locking fasteners may be actuated (extended) to their closed position, extending radially inwardly and entering the RFH housing bore (31 in FIG. 6) for supporting the bearing assembly (37 in FIG. 10) within the RFH housing (30 in FIG. 6). The running tool 60 with the bearing assembly 37 coupled thereto is lowered into the RFH housing bore (31 in FIG. 6), and the bearing assembly housing (40 in FIG. 10) engages the distal ends of the lower locking fasteners (see 38 in FIG. 7). The guide tracks (33A in FIG. 8) guide the bearing assembly (37 in FIG. 10) to cause the stop shoulder (33B in FIG. 8) to seat on the distal ends of the lower locking fasteners. The bearing assembly (37 in FIG. 1) is thus fully supported by the lower locking fasteners with the engagement between the locking fasteners and the stop shoulder. The bearing assembly (37 in FIG. 10) is also substantially prevented from rotational movement by the lower array of lag bolts when the bearing assembly housing (40 in FIG. 10) is fully seated within the RFH housing (30 in FIG. 10).

After the bearing assembly (37 in FIG. 10) is fully seated on the lower array of lag bolts, the upper array (36 in FIG. 8) of lag bolts can be actuated to secure the bearing assembly (37 in FIG. 10) within the RFH housing (30 in FIG. 10) and actuate the compression packing as explained above with reference to FIG. 5.

The running tool 60 can then be pulled up to test for weight and confirm that the bearing assembly 37 is fully secured within the RFH housing 30. After such confirmation, the running tool 60 is then moved downwardly to shear the shear pins 63 and free the running tool 60 from the bearing assembly 37. Once free, the running tool 60 may be removed from the riser, uncoupled from the tubular string (e.g., a drill string) thus permitting drilling operations to begin or resume. In a dual function running tool, the retrieving function may be disabled or otherwise made inactive during engagement of the bearing assembly to the bearing assembly housing. Arrangement of the shear pins and corresponding blocks is shown in plan view in FIG. 14 on the upper part of the cylindrical mandrel.

With reference to FIG. 12. the running tool 60 can further comprise a downhole portion having two or more outwardly biased dogs 64. The dogs 64 can be biased, e.g., by springs, to be in an open position, extending radially outwardly, for the removal or retrieval of the bearing assembly (37 in FIG. 10) from the RFH housing (30 in FIG. 1). In another example, the lower portion having the two or more outwardly biased dogs 64 can be disposed on a separate running tool.

To remove the bearing assembly (37 in FIG. 10) from the RFH housing (30 in FIG. 10), a running tool having the above described downhole portion may be assembled to the end of a tubular string (e.g., a drill string) and is moved longitudinally into the bearing assembly (37 in FIG. 10). The outwardly biased loaded dogs 64 compress as the dogs 64 run through the upper and lower sealing ("stripper") elements, e.g., 54 and 52 in FIG. 9), and then extend radially outwardly by action of the biasing mechanism (e.g., springs), after passing therethrough. The upper array of locking fasteners may be retracted to clear the RFH housing bore (31 in FIG. 6) by pulling upwardly on the running tool 60.

After passing the lower sealing element (52 in FIG. 9) and reopening to its biased open position, the running tool 60 is pulled upwardly to engage the lower ends of the lower sealing element (52 in FIG. 9). Although the frictional engagement between the lower sealing element (52 in FIG. 9) and the running tool 60 should be sufficient to cause the bearing assembly (37 in FIG. 10) to be retrieved by the upward movement of the running tool 60, the engagement of the dogs 64 with the lower sealing element (52 in FIG. 9) more reliably ensures retrieval of the bearing assembly (37 in FIG. 10).

In another example, the upper portion of the running tool 60 can further comprise spring-biased dogs for engaging the downhole lips of the upper sealing element (54 in FIG. 9)

Spring-biased dogs may provide advantages over running tools known in the art using hydraulically actuated dogs. Running tools using hydraulically actuated dogs known in the art are susceptible to failure because the tools require hydraulic lines to actuate the dogs to frictionally engage an inner wall of the bearing assembly. During deployment, it is common to have debris accumulate around the hydraulically actuated dogs, preventing the dogs from actuating and engaging the bearing assembly. Further, hydraulic lines are susceptible to damage which may prevent the dogs from being actuated.

Another disadvantage of tools using hydraulically actuated dogs is the sole reliance on a frictional engagement between the dogs and the bearing assembly. In the event that the frictional engagement is insufficient, particularly during retrieval, there is risk that the bearing assembly can slip and fall downhole. The disclosed invention is advantageous in that the spring-loaded dogs physically engage a downhole lip of the stripper element and the lower array of lag bolts remain in place, ensuring that even if the frictional engagement between the bearing assembly and the running tool is insufficient, the bearing assembly will not slip and fall.

A rotating flow head according to the various aspects of the invention may provide the ability to repair and or replace functional components more quickly than using rotating control heads known in the art. Further, a rotating flow head according to the invention may provide a full internal diameter bore equal to that of the riser into which it is connected, thereby enabling moving certain types of tools into the wellbore that cannot be moved through rotating control heads known in the art.

While the invention has been described with respect to a limited number of example implementations, those skilled in the art, having benefit of this disclosure, will appreciate that other implementations can be devised which do not depart from the scope of the invention as disclosed herein. Accordingly, the scope of the invention should be limited only by the attached claims.

What is claimed is:

1. A rotating flow head comprising:

a rotating flow head (RFH) housing having an internal bore, and at least one flow port;

a first array and a second array of radially extensible and retractable locking elements, wherein each array is disposed circumferentially around the RFH housing;

a bearing assembly (BA) housing having a total length defined between a top end and a bottom end opposite with respect to the top end and an exterior diameter less than a diameter of the internal bore of the RFH housing and providing an annular space between the BA housing and the RFH housing, the BA housing having profiles adjacent to the bottom end of the BA housing for engaging and being supported by the first array of locking elements in an extended position; and a sealing element disposed in the annular space, wherein the sealing element is energized by a downward force applied on the BA housing along a longitudinal direction with respect to the RFH housing, the second array of locking elements is located adjacent to the top end of the BA housing and applies the downward force on the BA housing by radially extending the second array of locking elements inward towards the internal bore of the RFH housing to directly engage a top surface on the top end of the BA housing and longitudinally move the BA housing downward, and the second array of locking elements in an extended position maintains the downward force applied on the BA housing.

2. The rotating flow head of claim 1 wherein at least one of the first array and the second array comprises lag bolts.

3. The rotating flow head of claim 1, wherein the top surface on the top end of the BA housing is a first tapered surface for engaging the second array of locking elements when the second array of locking elements is radially extended inward towards the internal bore of the RFH housing.

4. The rotating flow head of claim 3 wherein the second array of locking elements have second tapered surfaces for engaging the first tapered surface at the top end of the BA housing when the second array of locking elements is radially extended inward towards the internal bore of the RFH housing.

5. The rotating flow head of claim 4 wherein the second array of locking elements comprises lag bolts having the second tapered surfaces and engaging the first tapered surface at the top end of the BA housing when the second array of locking elements is radially extended inward towards the internal bore of the RFH housing.

6. The rotating flow head of claim 1, further comprising a mandrel positioned, at least partially, inside the BA housing and RFH housing, wherein the mandrel includes an upper sealing element and a lower sealing element configured to sealingly engage a tubular member inserted therethrough while enabling longitudinal movement of the tubular member.

7. The rotating flow head of claim 6 wherein the tubular member comprises a drill string.

8. The rotating flow head of claim 6, wherein the mandrel is rotatably, sealingly supported by longitudinally spaced apart tapered roller bearings, and seal elements disposed longitudinally externally of the longitudinal positions of the roller bearings to exclude wellbore fluids from the bearings.

9. The rotating flow head of claim 1 wherein the sealing element in the annular space comprises a T-seal.

10. The rotating flow head of claim 1, wherein the BA housing includes an annular offset into the annular space and the first array of locking elements is extensible into the annular space, the sealing element disposed between the annular offset and the first array of locking elements in the extended position.

11. The rotating flow head of claim 1 wherein the profiles are cavities that are tapered to guide the first array of the locking elements.

12. The rotating flow head of claim 1 wherein the profiles comprise guide channels and a support end engageable with ends of the first array of locking elements such that the first array of locking elements longitudinally supports the BA housing within the RFH housing.

13. The rotating control head of claim 1 wherein the RFH housing is coupled to a riser above a riser tensioning ring.

14. The rotating flow head of claim 1, wherein at least a portion of one selected from the top end of the BA housing and the locking elements of the second array of locking elements has a tapered shape.

15. A method comprising:

coupling a rotating flow head (RFH) housing to a wellbore riser at a selected position along the riser;

extending a first array of locking elements into an interior bore of the RFH housing from a retracted position outside the interior bore of the RFH housing;

inserting a bearing assembly (BA) housing into the RFH housing such that the first array of extended locking elements catches a first end portion of the BA housing moving through the interior bore, wherein the BA housing has a total length defined between a bottom end and a top end opposite with respect to the bottom end of the BA housing;

applying a downward longitudinal force to the BA housing to compress a sealing assembly disposed above the first array of extended locking elements and to longitudinally move the BA housing downward with respect to the RFH housing, wherein the downward longitudinal force is applied to the BA housing by extending locking elements of a second array of locking elements, located adjacent to the top end of the BA housing, radially inward towards the interior bore of the RFH housing such that tapered surfaces of the second array of locking elements engage the top end of the BA housing moving the BA housing downward with respect to the RFH housing and the BA housing is supported by the first array of extended locking elements.

16. The method of claim 15, wherein a tapered shape of the BA housing is a tapered surface provided at the top end of the BA housing.

17. The method of claim 15 wherein coupling the RFH housing is performed at a position in the riser above a riser tensioning ring.

18. The method of claim 15 further comprising hydraulically connecting at least one flow port in the RFH housing disposed below a position of the BA housing when inserted therein to a fluid return system in hydraulic communication with fluid handling equipment disposed on a drilling unit on the surface of a body of water.

19. A rotating flow head comprising:

a rotating flow head (RFH) housing having an internal bore with an internal diameter substantially equal to a diameter of a wellbore riser, at least one flow port, and a total length defined between a first end and a second end opposite to the first end of the RFH housing, wherein the internal diameter of the internal bore is consistent along the total length of the RFH housing;

a first array of radially extensible and retractable locking elements, wherein the first array is disposed circumferentially around the RFH housing;

a second array of radially extensible and retractable locking elements, wherein the second array is disposed circumferentially around the RFH housing at a top portion of the RFH housing that is positioned adjacent to the second end of the RFH housing and between the first and second ends of the RFH housing and the first array of locking elements are located between the second array of locking elements and the first end of the RFH housing; and a bearing assembly (BA) housing having an exterior diameter less than the internal diameter of the internal bore of the RFH housing providing an annular space between the BA housing and the RFH housing and a total length defined between a first end and a second end opposite to the first end of the BA housing, wherein the BA housing is engaged by the first array of locking elements when the first array of locking elements are extended and the BA housing is moved towards the first array of locking elements by a downward longitudinal force applied on the BA housing when the second array of locking elements at the top portion of the RFH housing is radially extended towards the internal bore of the RFH housing and engages a first surface at the first end of the BA housing.

20. The rotating flow head of claim 19, wherein at least one selected from the first surface at the first end of the BA housing and the locking elements of the second array comprises a tapered shape.

21. The rotating flow head of claim 19, wherein each locking element of the second array of locking elements comprises a first tapered surface and the first surface at the first end of the BA housing is a second tapered surface and the first tapered surface of each locking element contacts the second tapered surface of the BA housing when the locking elements of the second array engage the first surface at the first end of the BA housing.

22. A rotating flow head comprising:

a rotating flow head (RFH) housing having an internal bore, and at least one flow port;

a first array and a second array of radially extensible and retractable locking elements, wherein each array is disposed circumferentially around the RFH housing; and a bearing assembly (BA) housing having an exterior diameter less than a diameter of the internal bore of the RFH housing and providing an annular space therebetween, wherein the BA housing has a total length defined between a first end and a second end opposite with respect to the first end of the BA housing;

an annular offset of the BA housing extending into the annular space and disposed above the first array of radially extensible and retractable locking elements; and a seal disposed in the annular space adjacent and axially below the annular offset, wherein the first array of locking elements extend into the internal bore of the RFH housing and catch the BA housing moving into the RFH housing, and the BA housing is longitudinally moved downward with respect to the RFH housing by a force to be secured with respect to the RFH housing when the locking elements of the second array of locking elements are radially extended into the internal bore of the RFH housing and apply the force to the BA housing by engaging a first tapered surface at the first end of the BA housing, wherein the seal, in its entirety, is located between portions of the locking elements of the first array and the second array when the first array of locking elements and the second array of locking elements are extended into the internal bore of the RFH housing, and further wherein the seal is energized by the force to be secured with respect to the RFH housing when the locking elements of the second array of locking elements are radially extended into the internal bore of the RFH housing and engage the first tapered surface at the first end of the BA housing.

23. The rotating flow head of claim 22, wherein each locking element of the second array of locking elements comprises a second tapered surface and the first tapered surface of the BA housing contacts the second tapered surface of each locking element of the second array when the locking elements of the second array engage the first tapered surface of the BA housing.

* * * * *